United States Patent [19]

Grech

[11] Patent Number: 4,736,934

[45] Date of Patent: Apr. 12, 1988

[54] DOUBLE-ACTING VISE

[76] Inventor: Carmel J. Grech, 4020 Berwyn Dr., Santa Maria, Calif. 93455

[21] Appl. No.: 843,503

[22] Filed: Mar. 25, 1986

[51] Int. Cl.[4] ..... B25B 5/14

[52] U.S. Cl. ..... 269/110; 269/118; 269/155; 269/164; 269/242

[58] Field of Search ..... 269/155, 164, 242, 110, 269/118, 906

[56] References Cited

U.S. PATENT DOCUMENTS

| | | | |
|---|---|---|---|
| 78,922 | 6/1868 | Brecht . | |
| 370,541 | 9/1887 | Houston | 269/118 |
| 838,554 | 12/1906 | Lasance . | |
| 1,197,286 | 9/1916 | Hannay . | |
| 1,464,389 | 8/1923 | Lancaster | 269/164 |
| 1,730,510 | 10/1929 | Jensen | 269/164 |
| 1,961,036 | 5/1934 | Boyle | 269/118 |
| 2,062,326 | 12/1936 | Minch | 269/118 |
| 2,322,380 | 6/1943 | Mosley | 269/164 |
| 2,552,094 | 5/1951 | Hamon et al. | 269/242 |
| 2,723,579 | 11/1955 | Johnson . | |
| 3,420,124 | 1/1969 | Trevathan | 269/242 |
| 4,054,281 | 10/1977 | Martinsson | 269/110 |
| 4,527,786 | 7/1985 | Hsu | 269/155 |

*Primary Examiner*—Robert C. Watson

*Attorney, Agent, or Firm*—Gordon L. Peterson

[57] ABSTRACT

A double-acting vise comprising a supporting structure, a first set of jaws mounted on the supporting structure for movement toward and away from each other, and a second set of jaws mounted on the supporting structure for movement toward and away from each other. All of the jaws move relative to the supporting structure.

12 Claims, 1 Drawing Sheet

DOUBLE-ACTING VISE

BACKGROUND OF THE INVENTION

A conventional vise has a fixed jaw and a movable jaw between which a workpiece can be clamped. One disadvantage with a vise of this type is that it is not possible to center workpieces of different sizes with respect to an external member by simply clamping the workpiece in the vise.

To provide for locating of a workpiece along a line or axis, it is known to mount both of the jaws for movement together toward and away from each other. Although this arrangement locates the workpiece along a line with respect to an external member, it does not provide for centering the workpiece with respect to such external member. In other words, it is not possible with this arrangement to accurately locate workpieces in a plane or center workpieces of varying sizes with respect to an external member.

The centering of a workpiece, regardless of its size with respect to an external member, is desirable in various situations. For example, it may be desired to drill a hole in the center of workpieces of different dimensions. With conventional vises, this requires a separate setup of the vise and drill press for each different size workpiece. This is undesirably time consuming.

SUMMARY OF THE INVENTION

This invention provides a double-acting vise which can be used to center workpieces of different dimensions with respect to an external member, such as the drill of a drill press. Only a single setup of the double-acting vise of this invention is required. Thereafter, workpieces of different dimensions can be placed into the vise, and the vise automatically centers the workpieces with respect to the external member.

This invention can be embodied, for example, in a double-acting vise which includes a supporting structure and two pairs of jaws. The jaws of each pair are mounted for movement relative to the supporting structure toward and away from each other in such a way that workpieces of varying sizes are automatically centered.

More specfically, the first pair of jaws may include first and second jaws, and the vise includes first mounting means for mounting the first and second jaws on the supporting structure for movement relative thereto along a first axis toward and away from each other so that a workpiece can be gripped between such jaws. First drive means is provided for moving the first and second jaws along the first axis. The second pair of jaws includes third and fourth jaws, and the vise includes second mounting means for mounting the third and fourth jaws on the supporting structure for movement relative thereto along a second axis toward and away from each other so that a workpiece can be gripped between these jaws. Second drive means operable independently of the first drive means moves the third and fourth jaws along the second axis. To enable the two pair of jaws to work together, the first axis extends generally transverse to the second axis, and the first and second mounting means mounts the jaws so that the jaws can be moved toward and away from a common center.

Setup of the double-acting vise can be quickly and easily accomplished by gripping an external member, such as a centering member of the machine, which may be a drill press, between the two sets of jaws. With the centering member gripped in this fashion, the supporting structure of the double-acting vise is fixed in position relative to the centering member. The workpiece can then be centered by gripping it between the two sets of jaws. The workpiece will be centered regardless of its dimensions in a plane transverse to the direction in which the centering member extends.

Although the second pair of jaws can be mounted in different ways, it is preferred to mount them on the first jaw. In a preferred construction, the first and second jaws have confronting jaw faces, and the third and fourth jaws project from the jaw face of the first jaw toward the jaw face of the second jaw. So that the third and fourth jaws do not interfere with movement of the two jaw faces close to each other, the jaw face of the second jaw has an opening therein for receiving at least outer end portions of the third and fourth jaws. This enables the jaw faces to be moved closer together than the distance the third and fourth jaws project from the jaw face of the first jaw. To provide a compact and efficient structure, the first jaw can advantageously have a chamber, and at least portions of the mounting means and drive means for the second pair of jaws are in the chamber. In this event, the third and fourth jaws project out of the chamber toward the second jaw.

Although the supporting structure can take different forms, in a preferred construction, it includes a base and opposed end plates mounted on the base. Although the mounting means for the first pair of jaws may also be of various different constructions, in one preferred form, it includes at least one rod extending between the plates and first and second mounting members receiving the rod and coupled to the first and second jaws, respectively.

The invention, together with additional features and advantages thereof, may best be understood by reference to the following description taken in connection with the accompanying illustrative drawing.

DESCRIPTION OF THE PREFERRED EMBODIMENT

Figure 1:
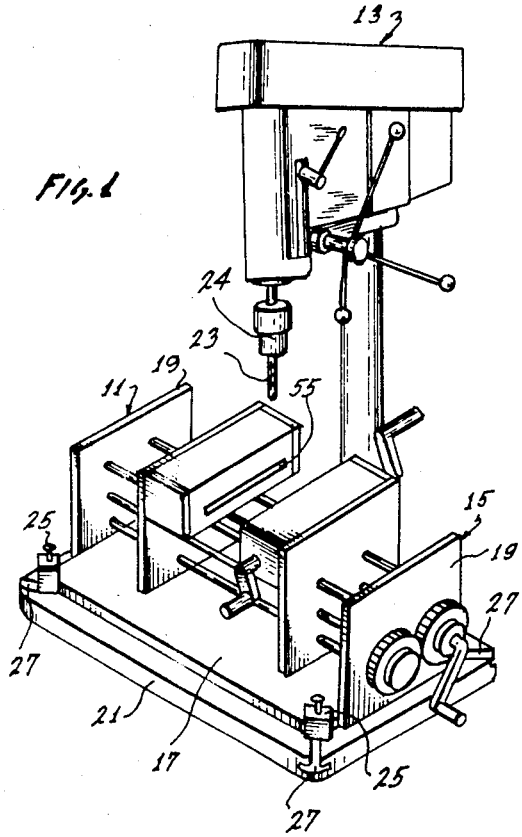
FIG. 1 is a perspective view of a double-acting vise constructed in accordance with the teachings of this invention and a drill press.

FIG. 1 shows a double-acting vise 11 being used in connection with a conventional drill press 13. The vise 11 includes supporting structure 15, which in this embodiment includes a base 17 in the form of a rectangular metal plate and opposed metal end plates 19 suitably mounted in parallel relationship at the opposite ends of the base.

Although the vise 11 can be used in various different environments, in the illustrated embodiment, the base 17 rests on a table 21 of the drill press 13. The drill press 13 has a centering member, which may be a drill bit 23 (FIG. 1) or a long rod 23*a* (FIG. 3) removably mounted in a chuck 24 of the drill press, and the base 17 may be fixed in position relative to the table 21 and the drill bit 23 in any suitable manner, such as by a plurality of releasable clamps 25 (only two being shown in FIG. 1).

The clamps 25 are movable in slots 27 in the table 21 so that the base 17 can be fixed in many different positions in an X-Y plane which is transverse to the longitudinal axis of the drill bit 23.

Jaws 29 and 31, which constitute a first pair of jaws, are mounted for movement relative to the supporting structure 15 toward and away from each other by suitable mounting means, which, in this embodiment, include a plurality of guide rods 33 and a plurality of threaded rods 35. The rods 33 and 35 are parallel and appropriately mounted at their opposite ends in the end plates 19. The rods 33 and 35 extend through mounting members 37, which in this embodiment are in the form of parallel plates. The mounting members 37 carry internal threads 39, which cooperate with the threaded rods 35 so that rotation of the threaded rods can move the mounting members and the associated jaws 29 and 31 toward and away from each other. Thus, the threaded rods 35 form a portion of the mounting means for the jaws 29 and 31 and also a portion of the driving means for the jaws.

Although the threaded rods 35 can be rotated in different ways, in this embodiment, a crank 41 is mounted on one of the end plates 19 and directly drives one of the threaded rods 35 in one direction. The other of the threaded rods 35 is driven in the opposite direction by gears 43 and 45 coupled to the crank 41 and such other threaded rod 35. Although various driving arrangements can be employed, in the illustrated embodiment, both of the threaded rods 35 have right and lefthand threaded portions so that both of these rods can drive both of the mounting members 37 and the associated jaws 29 and 31.

Although the jaws 29 and 31 can be of different constructions, in the embodiment illustrated, each of them is generally in the form of a rectangular solid having a chamber 47 therein and confronting parallel jaw faces 49 and 51, respectively. The jaw faces 49 and 51 have slots or recesses 53 and 55, respectively, therethrough leading to the associated chambers 47.

Jaws 57 and 59 are mounted on a threaded rod 61 which has righthand and lefthand threads so that rotation of the rod 61 can move the jaws 57 and 59 toward and away from each other. The rod 61 is suitably mounted in end walls 63 of the jaw 29, and cranks 65 are joined to the opposite ends of the rod 61 to facilitate manual rotation of the rod 61.

Each of the jaws 57 and 59 has a nut portion 67 cooperable with the threaded rod 61 to permit the latter to move the jaws toward and away from each other. Although the jaws 57 and 59 can be of different constructions, in this embodiment, each of them also includes an elongated finger portion 69 which projects out through the slot 53 and toward the jaw 31. The purpose for the slot 53 is to allow the finger portions 69 to protrude from the jaw 29 and to prevent rotation of the jaws 57 and 59 on the rod 61. In this regard, the slot 53 may take the form of one or more openings of any suitable configuration and, of course, other means for preventing rotation of the jaws 57 and 59 on the rod 61 can be employed.

The slot 55 constitutes an opening for receiving at least the outer end portions of the jaws 57 and 59. This enables the jaw faces 49 and 51 to be moved closer together than the distance the jaws 57 and 59 project from the jaw face 49.

Figure 3:
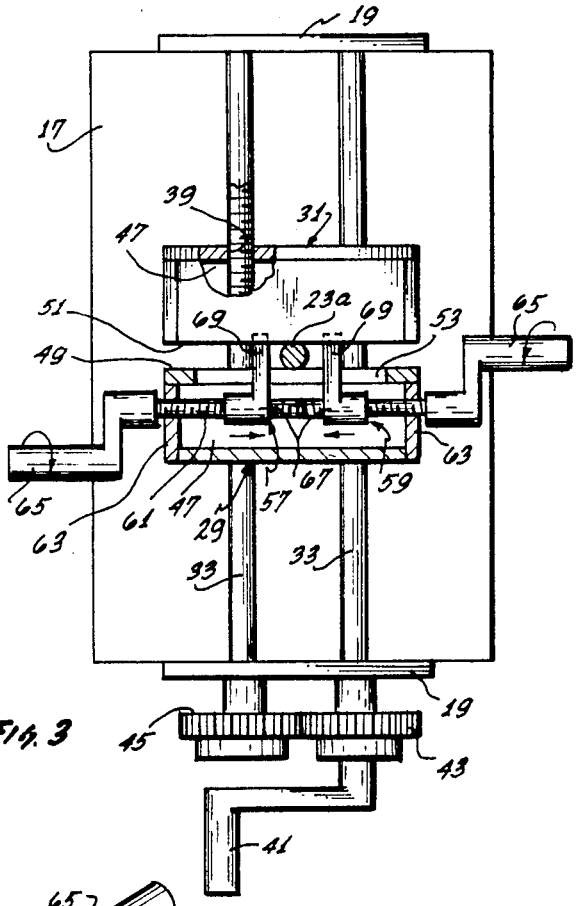
FIG. 3 is a top plan view of the double-acting vise with portions illustrated in section.
Figure 2:
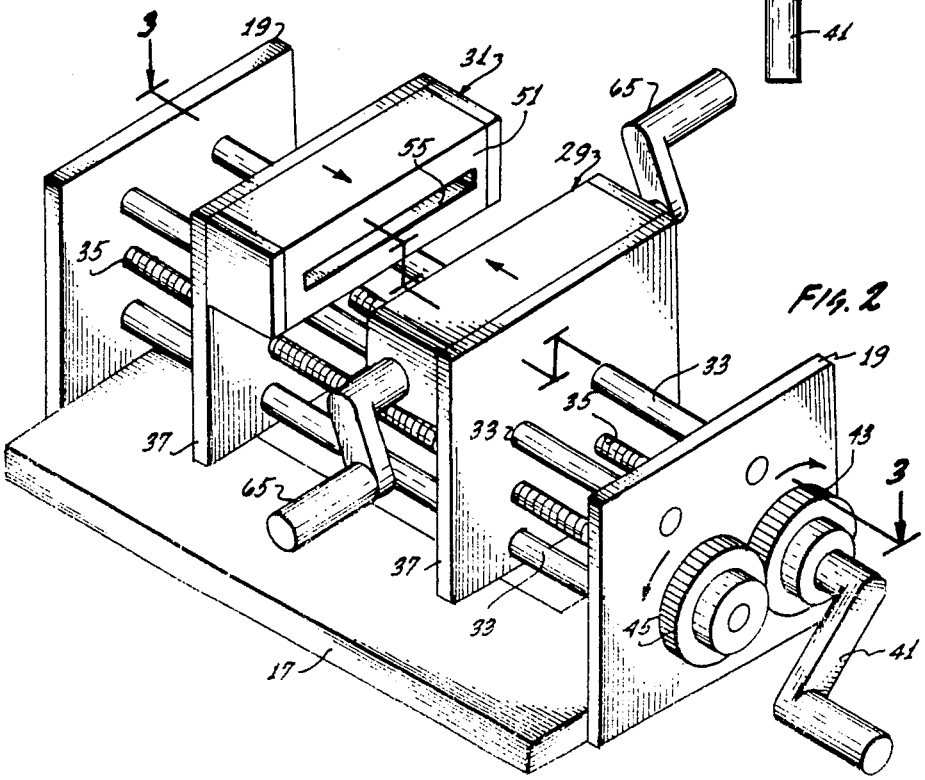
FIG. 2 is an enlarged, perspective view of the double-acting vise.

With the structure described above, the jaws 29 and 31 can be moved toward and away from each other along a first axis, the direction of which is established by the rods 33 and 35. Similarly, the jaws 57 and 59 can be moved toward and away from each other along a second axis which is defined by the rod 61. The two axes are transverse, and in this embodiment, they are perpendicular as viewed in plan (FIG. 3). In addition, with this construction, the jaws are mounted so that they can be moved toward and away from a common center, such as the axis of the drill bit 23 or rod **23*a*. A workpiece (not shown) can be gripped between the jaws 29 and 31 and/or the jaws 57 and 59**.

The double-acting vise 11 can be used for holding and centering workpieces of various dimensions with respect to the drill bit 23. For example, the drill bit 23 or the elongated rod **23*a*, which projects a greater distance downwardly than the drill bit, can be used as a centering member in setting up the vise 11. Assuming that the rod 23*a* is to be used as the centering member, it is mounted in the chuck of the drill press 13, and it projects downwardly along the same axis which the drill bit 23 did, and the rod is gripped between the jaws 57 and 59 and the jaws 29 and 31. With the rod 23*a* so gripped, the base 17 is fixed in position relative to the rod 23*a* by tightening the clamps 25. Thereafter, the rod 23*a* is replaced with the drill bit 23 and a workpiece of any dimensions that can be accepted by the jaws will be automatically centered relative to the drill bit upon tightening of the jaws about the workpiece. For example, a workpiece may be gripped between the jaws 57 and 59 and the jaw faces 49 and 51 to thereby accurately locate the center of the workpiece immediately below the drill bit 23**. To drill a hole offset from the center of the workpiece, the workpiece can be spaced from the appropriate jaw as by a shim.

Although an exemplary embodiment of the invention has been shown and described, many changes, modifications and substitutions may be made by one having ordinary skill in the art without necessarily departing from the spirit and scope of this invention.

I claim:

1. A double-acting vise comprising:

a supporting structure;

first and second jaws;

first mounting means for mounting said first and second jaws on the supporting structure for movement relative thereto along a first axis toward and away from each other whereby a workpiece can be gripped between said first and second jaws;

first drive means for moving the first and second jaws along said first axis;

third and fourth jaws;

second mounting means for mounting said third and fourth jaws on the supporting structure for movement relative thereto along a second axis toward and away from each other whereby a workpiece can be gripped between said third and fourth jaws;

second drive means for moving the third and fourth jaws along said second axis, said first and second drive means being operable independently of each other;

said first axis extending generally transverse to said second axis;

said first and second mounting means mounting said jaws so that all of said jaws can be moved toward and away from a common center; and the first jaw having a chamber and at least portions of said second mounting means and said second driving means are in said chamber and said third and fourth jaws project out of said chamber toward the second jaw.

2. A vise as defined in claim 1 wherein said first drive means enables the simultaneous movement of the first and second jaws equally and oppositely along said first axis and the second drive means enables the simultaneous movement of the third and fourth jaws equally and oppositely along said second axis.

3. A double-acting vise comprising;

a supporting structure;

first and second jaws;

first mounting means for mounting said first and second jaws on the supporting structure for movement relative thereto along a first axis toward and away from each other whereby a workpiece can be gripped between said first and second jaws;

first drive means for moving the first and second jaws along said first axis;

third and fourth jaws;

second mounting means for mounting said third and fourth jaws on the supporting structure for movement relative thereto along a second axis toward and away from each other whereby a workpiece can be gripped between said third and fourth jaws;

second drive means for moving the third and fourth jaws along said second axis, said first and second drive means being operable independently of each other;

said first axis extending generally transverse to said second axis;

said first and second mounting means mounting said jaws so that all of said jaws can be moved toward and away from a common center; and said second mounting means mounting the third and fourth jaws solely on the first jaw.

4. A vise as defined in claim 3 wherein the second jaw has a recess for receiving portions of the third and fourth jaws.

5. A double-acting vise comprising, a supporting structure;

first and second jaws;

first mounting means for mounting said first and second jaws on the supporting structure for movement relative thereto along a first axis toward and away from each other whereby a workpiece can be gripped between said first and second jaws;

first drive means for moving the first and second jaws along said first axis;

third and fourth jaws;

second mounting means for mounting said third and fourth jaws on the supporting structure for movement relative thereto along a second axis toward and away from each other whereby a workpiece can be gripped between said third and fourth jaws;

second drive means for moving the third and fourth jaws along said second axis, said first and second drive means being operable independently of each other;

said first axis extending generally transverse to said second axis;

said first and second mounting means mounting said jaws so that all of said jaws can be moved toward and away from a common center; and said axes defining a plane and no portion of said first and second drive means being aligned with a perpendicular reference line through said plane at said common center.

6. A vise as defined in claim 5 wherein said second mounting means mounts the third and fourth jaws on the first jaw.

7. A vise as defined in claim 6 wherein said first and second jaws have confronting jaw faces, said third and fourth jaws project from said jaw face of the first jaw toward the jaw face of the second jaw and the jaw face of the second jaw has an opening therein for receiving at least outer end portions of the third and fourth jaws whereby the jaw faces of the first and second jaws can be moved closer together than the distance the third and fourth jaws project from the jaw face of the first jaw.

8. A vise as defined in claim 6 wherein the first jaw has a chamber and at least portions of said second mounting means and said second driving means are in said chamber.

9. A vise as defined in claim 5 wherein said supporting structure includes a base and opposed end plates mounted on the base and said first mounting means includes at least one rod extending between said plates and first and second mounting members receiving said rod and coupled to said first and second jaws, respectively.

10. A vise as defined in claim 9 wherein said first driving means includes cooperating threads carried by the rod and the mounting members.

11. A vise as defined in claim 9 wherein the first jaw has a chamber and at least portions of said second mounting means and said second driving means are in said chamber and said third and fourth jaws project out of said chamber toward the second jaw.

12. A double-acting vise comprising:

a supporting structure;

first and second jaws;

first mounting means for mounting said first and second jaws on the supporting structure for movement relative thereto along a first axis toward and away from each other whereby a workpiece can be gripped between said first and second jaws;

first drive means for moving the first and second jaws along said first axis;

third and fourth jaws;

second mounting means for mounting said third and fourth jaws on the supporting structure for movement relative thereto along a second axis toward and away from each other whereby a workpiece can be gripped between said third and fourth jaws;

second drive means for moving the third and fourth jaws along said second axis, said first and second drive means being operable independently of each other;

said first axis extending generally transverse to said second axis;

said first and second mounting means mounting said jaws so that all of said jaws can be moved toward and away from a common center;

said supporting structure including a base and opposed end plates mounted on the base and said first mounting means including at least one rod extending between said plates and first and second mounting members receiving said rod and coupled to said first and second jaws, respectively; and the first jaw having a chamber and at least portions of said second mounting means and said second driving means being in said chamber and said third and fourth jaws projecting out of said chamber toward the second jaw.

* * * * *